US006042632A

United States Patent [19]

George

[11] Patent Number: 6,042,632

[45] Date of Patent: Mar. 28, 2000

[54] METHOD OF MODERATING TEMPERATURE PEAKS IN AND/OR INCREASING THROUGHPUT OF A CONTINUOUS, TOP-BLOWN COPPER CONVERTING FURNACE

[75] Inventor: David B. George, Salt Lake City, Utah

[73] Assignee: Kennecott Holdings Company, Salt Lake City, Utah

[21] Appl. No.: 08/936,322

[22] Filed: Sep. 24, 1997

Related U.S. Application Data

[63] Continuation-in-part of application No. 08/587,464, Jan. 17, 1996, abandoned.

[51] Int. Cl.[7] ..... C21C 1/04

[52] U.S. Cl. ..... 75/382; 75/643; 75/644; 75/645

[58] Field of Search ..... 75/643, 644, 645, 75/382

[56] References Cited

U.S. PATENT DOCUMENTS

| | | | |
|---|---|---|---|
| 4,211,556 | 7/1980 | Nagano et al. | 75/74 |
| 4,415,356 | 11/1983 | Victorovich et al. | 75/21 |
| 4,416,690 | 11/1983 | Richards et al. | 75/639 |
| 4,470,845 | 9/1984 | Yannopoulos | 75/23 |
| 4,599,108 | 7/1986 | Hanniala | 75/73 |
| 4,614,542 | 9/1986 | Kimura et al. | 75/643 |
| 4,645,186 | 2/1987 | Hanniala | 266/212 |
| 5,007,959 | 4/1991 | Reist et al. | 75/645 |
| 5,143,355 | 9/1992 | Iwamura et al. | 266/160 |
| 5,176,875 | 1/1993 | Kanazumi et al. | 266/241 |
| 5,178,818 | 1/1993 | Ikoma et al. | 266/196 |
| 5,180,422 | 1/1993 | Kikumoto et al. | 75/643 |
| 5,205,859 | 4/1993 | Goto et al. | 75/640 |
| 5,215,571 | 6/1993 | Marcuson et al. | 75/626 |
| 5,217,527 | 6/1993 | Goto et al. | 75/645 |
| 5,308,379 | 5/1994 | Ishida et al. | 75/646 |
| 5,320,662 | 6/1994 | Goto et al. | 75/645 |
| 5,320,799 | 6/1994 | Goto et al. | 266/213 |
| 5,380,353 | 1/1995 | Goto et al. | 75/640 |
| 5,449,395 | 9/1995 | George | 75/586 |

*Primary Examiner*—Melvyn Andrews
*Attorney, Agent, or Firm*—Whyte Hirschboeck Dudek SC

[57] ABSTRACT

Solidified copper matte is used as a coolant to moderate or reduce the temperature of a bath of molten blister copper resident within a continuous, top-blown converter. In one embodiment, the addition of solidified copper matte to a bath of molten blister copper resident within a continuous, top-blown converter increases the throughput of the converter.

10 Claims, No Drawings

METHOD OF MODERATING TEMPERATURE PEAKS IN AND/OR INCREASING THROUGHPUT OF A CONTINUOUS, TOP-BLOWN COPPER CONVERTING FURNACE

This application is a continuation in part of application Ser. No. 08/587,464, filed on Jan. 17, 1996 now abandoned.

BACKGROUND OF THE INVENTION

This invention relates to a process for converting copper sulfide concentrates to anode copper. In one aspect, the invention relates to the conversion of copper matte to blister copper while in another aspect, the invention relates to a process which utilizes solidified copper matte to remove heat from and/or increase the throughput of a continuous, top-blown copper converting furnace.

U.S. Pat. Nos. 5,205,859 and 5,217,527, both to Goto, et al. and both incorporated herein by reference, describe a continuous process for converting copper concentrates to anode copper (the "Mitsubishi process"). The smelting apparatus used in the Mitsubishi process comprises (i) a smelting furnace for melting and oxidizing copper concentrates to produce a mixture of matte and slag, (ii) a separating furnace for separating the matte from the slag, (iii) a converting furnace for oxidizing the matte separated from the slag to produce blister copper, and (iv) a plurality of anode furnaces for refining the blister copper into anode copper. All of the furnaces are arranged in descending order with the smelting furnace at the highest elevation and the anode furnaces at the lowest elevation such that the processed copper is gravity transferred (i.e. cascades) in liquid or molten form from one to another through launders. In an alternative embodiment not described in these patents, one or more ladles are employed to transfer intermediate product (e.g. molten matte) from a lower elevation to a higher elevation to initiate the casacading effect over at least a part of the smelting process. Furthermore, the roof of each of the smelting and converting furnaces is fitted with a plurality of vertical lances through which one or more of copper concentrates (in the smelting furnace only), oxygen-enriched air, and flux are supplied to these furnaces.

The converting furnace is designed and positioned to receive a continuous flow of molten matte from the separation furnace. The converting furnace holds in its basin N (also known as a settler region) a bath of molten blister copper which was formed by the oxidation of molten copper matte that was fed earlier to the furnace. The bath typically comprises blister copper of about one meter in depth upon which floats a layer of slag of about 12 centimeters in thickness. As the liquid matte flows into the converting furnace, it spreads across the surface of the bath towards the lances and mixes with the blister copper forming an unstable molten matte phase (the bath does not contain a stable layer of molten copper matte). The high velocity oxygen-containing gas and flux from the lances penetrate through the slag and into the molten blister copper to form a foam/emulsion in which the molten copper matte is converted to molten blister copper. The newly-formed molten blister copper displaces existing molten blister copper out of the furnace, e.g. through tapholes, or a syphon, or a forehearth, etc., and the newly-formed slag flows toward a slag taphole for eventual removal from the furnace.

Since the oxidation of the iron and sulfur values in the molten matte is an exothermic reaction, considerable heat is generated within the converting furnace. Moderation and control of this heat, i.e. moderation and control of the temperature of the bath, particularly the temperature peaks, is important not only to the efficient operation of the furnace (and thus to the production of blister copper), but also to the life of the furnace refractory and other components. Prolonged periods of these temperature peaks, i.e. temperatures significantly in excess of the that required to the effect the reaction of molten matte (Cu—Fe—S) with oxygen ($O_2$) and flux (e.g. CaO) to form copper metal ($Cu^0$), molten slag ($Cu_2O$—CaO—$Fe_3O_4$) and gaseous sulfur dioxide ($SO_2$), can significantly shorten the life of the furnace refractory.

The temperature of the bath can be moderated by one of two methods. First, the amount of heat generated can be limited and second, the excess heat can be removed. Limiting the amount of heat generated requires controlling the amount and quality of reactants introduced into the bath. For example, one method of limiting the amount of heat generated is to introduce nitrogen into the furnace, thus reducing the level of oxygen enrichment. However, the addition of nitrogen reduces furnace throughput and depending on its manner of introduction, can increase bath turbulence. Moreover, controlling the quality of the reactants (e.g. the relative amounts of copper, iron and sulfur in the matte, etc.) is difficult at best due to the varying compositional nature of the starting materials, particularly the concentrate feed to the smelting furnace, and because the furnace is part of an continuous operation, any such measure has a ripple effect both up- and downstream.

Removing excess heat from the bath can be accomplished by a number of techniques two of which are heat transfer, e.g. by a cooling jacket and/or strategically placed cooling blocks, and by the introduction of a coolant, e.g. a material that absorbs heat upon its introduction into the bath (of which scrape anode copper and recycled converter slag are good examples). The addition of a coolant is practiced with both top-blown and other furnace designs, e.g. a Pierce-Smith converter as described in U.S. Pat. No. 5,215,571 to Marcuson, et al. However, the addition of copper scrap, particularly scrap copper anode, has it own set of problems not the least of which are sizing (e.g. shredding scrap copper anodes), introduction into the furnace (improper introduction can result in damage to the furnace), and the introduction of impurities into the molten blister copper, e.g. the noncopper values present in the coolant (which must ultimately be removed from the blister copper).

SUMMARY OF THE INVENTION

According to the present invention, solidified copper matte is used as a coolant to moderate or reduce the temperature of a molten blister copper bath resident within a continuous, top-blown converting furnace such as that used in the Mitsubishi process. The solid matte is the product of a solidification process in which molten copper matte is granulated or otherwise solidified, sized, and then fed to the bath within the converting furnace as a coolant. The remelting of the matte consumes bath heat, thus lowering the temperature of the bath.

In one embodiment of the invention, the addition of the solidified matte increases the throughput of the converting furnace independent of the throughput capacity of the furnaces upstream from it in that more total (molten plus solid) matte is converted to blister copper than that received from an upstream furnace.

In another embodiment, the separating furnace that is the source of the molten copper matte for the feed to the converting furnace is also the source of the molten copper matte that is converted into the solid copper matte.

In another embodiment of this invention, a method for continuous copper smelting comprises the steps of:

A. Providing a smelting furnace connected by first transfer means to a separating furnace, which in turn is connected by second transfer means to a continuous, top-blown converting furnace, which in turn is connected by third transfer means to at least one anode furnace;

B. Adding to and then melting and oxidizing in the smelting furnace a copper concentrate to produce a mixture of molten copper matte and slag;

C. Transferring the mixture of molten copper matte and slag by the first transfer means to the separating furnace in which the matte is separated from the slag;

D. Transferring the molten copper matte by the second transfer means to a bath of molten blister copper resident within the converting furnace in which the matte is oxidized to produce molten blister copper;

E. Adding a solid copper matte to the bath of molten blister copper for absorbing heat produced within the bath during the oxidation of the matte received from the separation furnace; and F. Transferring the molten blister copper by the third transfer means to at least one anode furnace in which the blister copper is refined into anode copper.

The transfer means include crane and ladle systems and launders, and preferably all the transfer means are launders. The equipment of the process train of this embodiment can include one or more holding furnaces. In one particular embodiment, a holding furnace replaces the separation furnace.

DETAILED DESCRIPTION OF THE INVENTION

The smelting of copper concentrates may be carried out in any suitable manner using any suitable equipment. Generally, the solid copper concentrates are introduced into a smelting furnace of any conventional design, preferably a flash smelting furnace, which is fired by the introduction of fuel and air and/or oxygen through a conventional burner, and from which slag is tapped periodically and off-gases are routed to waste handling or are recycled. More particularly, the copper concentrates are blown into the a smelting furnace through lances together with the oxygen-enriched air. The copper concentrates are thus partially oxidized and melted due to the heat generated by the oxidation of the sulfur and iron values in the concentrates so that a liquid or molten bath of matte and slag is formed and collected in the basin of the furnace. The matte contains copper sulfide and iron sulfide as its principal constituents, and it has a high specific gravity relative to the slag. The slag, on the other hand, is composed of gangue mineral, flux, iron oxides and the like, and it has a low specific gravity relative to the matte. The molten copper matte and slag can be separated in any conventional manner and in the Mitsubishi Process, a mixture of matte and slag overflows from an outlet of the smelting furnace through a launder and into a separating furnace.

In the Mitsubishi Process, the liquid or molten mixture of matte and slag which overflows into the separating furnace (also known as a slag cleaning furnace) is separated into two immiscible layers, one of matte and the other of slag (the layers are immiscible due to the differences in the specific gravity of matte and slag). The molten copper matte is withdrawn from the separating furnace and is routed into the converting furnace through another launder.

In an alternative embodiment, molten matte without the slag is tapped or otherwise removed from the smelting furnace and transferred by ladle, launder or other means to a holding furnace. Here the matte is retained in a molten state until required by the converting furnace at which time it is transferred to the converting furnace by any conventional means, e.g. ladle, launder, etc.

As described above, the molten copper matte fed to the converting furnace spreads across the surface of resident bath of molten blister copper and slag towards the vertical lances and mixes with the blister copper forming an unstable molten matte phase. The high velocity gases from the lances form a foam/emulsion with the matte in which the matte is converted to blister copper, slag and gaseous sulfur dioxide. The newly-formed blister copper displaces resident blister copper from the furnace, the slag flows toward one or more slag tapholes, and the gaseous sulfur dioxide is captured for further processing.

As the copper matte is oxidized, large amounts of heat are evolved. Ideally, the matte, oxygen and flux are mixed such that only that heat necessary to sustain the oxidation reaction (i.e. the oxidation of the sulfur and iron values in the matte) is generated. However, this degree of control is difficult, if not impossible, to maintain for any length of time and as such, excess heat is typically generated. These temperature peaks, however, are unnecessary to the sustained oxidation of the sulfur and iron values in the matte, and they pose potential harm to the refractory of the furnace.

According to this invention, the molten blister copper temperature peaks experienced during the typical operation of a continuous, top-blown converting furnace are removed or moderated by the addition of solid copper matte (crushed or otherwise sized) to a molten blister copper bath such that the bath temperature is reduced and maintained at an acceptable level. The solid copper matte can be added continuously or on a batch basis, and the solid copper matte is added in a quantity sufficient to moderate (i.e. reduce and/or maintain) the temperature of the bath. This solid copper matte acts to maintain the temperature of the bath, typically within a range of about 1100° C. to about 1400° C., preferably between about 1200° C. and about 1350° C. The solid copper matte, particularly that produced by the separation furnace that produces the molten copper matte feed for the converting furnace, also serves as a source for additional converter feed without introducing unwanted impurities such as those associated with copper scrap or slag.

The solid copper matte is added to the converting furnace in the form of cold (e.g. room temperature), crushed particles typically of about 0.1 to 4 millimeters in average diameter. These particles can be added to the furnace in any convenient manner, e.g. through an opening in the furnace roof or if the particles are of a sufficiently fine size, such as a powder produced by grinding, through a lance. As previously noted, these particles are preferably derived from the molten copper matte cleaned in the separating furnace that is upstream of the continuous, top-blown converting furnace, and this matte contains copper, iron, sulfur, and varying quantities of minor metallic and nonmetallic constituents. Upon withdrawal from the separating furnace, the molten copper matte is solidified and size reduced in any convenient manner.

Any practical means may be employed to produce solid, preferably finely divided, particles from molten copper matte. Such matte may be granulated by discharge into water or may be atomized in fine droplet from, and the solidified matte can be sized reduced by crushing and/or grinding into finely-divided, particles utilizing standard crushing and grinding equipment. Usually the crushed, cold matte is stored for subsequent use in the process since it is desirable to have an adequate supply in reserve from which to draw for feeding a converting furnace on a continuous and efficient basis.

As the oxidation reactions in the converting furnace progress, the slag layer is periodically skimmed, or it is allowed to continuously overflow, and additions of solid copper matte as a coolant are made as necessary. The matte (both liquid and solid) is converted into blister copper which typically has a purity of greater than about 98%, and the blister copper is tapped from one or more outlets in the converting furnace into one or more launders connecting the converting furnace with one or more anode furnaces in which it is converted into anode copper (typically with a purity in excess of 99% copper). Since the slag recovered from the converting furnace has a relatively high copper content, it is typically recycled to the smelting furnace (after granulation and drying).

The process of this invention is also useful for increasing the throughput of a continuous, top-blown converting furnace. The introduction of solidified copper matte is an additional source of feed for the furnace, over and above the molten matte provided by the separation furnace, and as such this addition provides a throughput converter capacity independent of the throughput capacity of the upstream furnaces.

Moreover, the process of this invention is useful for maintaining the continuous operation of the continuous, top-blown converting furnace when one or more upstream, e.g. the smelting and/or slag separation, furnaces are fully or partially down for whatever reason. Under these conditions the operation of the converting furnace, and the downstream anode furnace(s), can be maintained by feeding the converting furnace with sufficient solidified matte, flux and oxygen such that the iron and sulfur values in the matte are oxidized (as described in U.S. Pat. No. 4,416,690 which is incorporated herein by reference).

Alternatively, the use of solidified matte as a coolant in the converting furnace allows for the continued operation of the upstream furnaces when the converting furnace or other downstream equipment is fully or partially down for whatever reason because the output of the slag separation furnace can be converted into solidified matte for storage and later conversion into blister copper. Of course whenever the converting furnace is operating primarily or exclusively on solidified matte feed, its operation will require greater amounts of oxygen as compared to its operation primarily on molten matte. However these resources will be available from the oxygen resources of the down furnaces.

Although not described above, the equipment of the smelting process of which this invention is a part, e.g. the Mitsubishi process, can comprise one more holding furnaces. These furnaces can be placed at any convenient location(s) within the process train, e.g. between the separating furnace and the converter, between the converter and the anode furnace(s), etc., and are connected to the other furnaces in the train by any convenient means, e.g launder, ladle, etc. Of course, in those embodiments of this invention in which a holding furnace is located between the separating furnace and the converting furnace, the molten copper matte fed to the converting furnace is sourced from the holding furnace (in the absence of bypass). In one particular embodiment, a holding furnace replaces the separation furnace.

The converting furnace used in the practice of this invention is a continuous, top-blown converting furnace as opposed to a flash converting furnace or a Peirce-Smith converting furnace. The continuous, top-blown converting furnaces used in this invention are designed to accept on a continuous basis molten copper matte, typically from a separating furnace by way of one or more launders, and to convert the matte to blister copper by admixing the former with oxygen and flux fed into the furnace from roof-mounted vertical lances (as described in U.S. Pat. Nos. 5,205,859 and 5,217,527). In comparison, flash converting furnaces (which are usually operated in a continuous mode), such as that described in U.S. Pat. No. 4,416,690, are fed solidified (not molten) copper matte, and Peirce-Smith converting furnaces (which are fed molten copper matte, typically by a crane and ladle assembly) are operated on a noncontinuous, i.e. batch, basis.

The following example further describes and demonstrates an embodiment of the present invention.

EXAMPLE

Copper concentrates are blown into a smelting furnace through lances together with oxygen-enriched air. These copper concentrates are partially oxidized and melted due to the heat generated by the oxidation so that a mixture of matte and slag is created in the form of a bath collected in the basin of the furnace. This mixture overflows through an outlet in the smelting furnace through a launder and into a separating furnace in which it is separated into two immiscible layers of matte and slag. Part of the molten copper matte is withdrawn from the separating furnace, solidified, and then reduced in size; the remainder of the molten copper matte is transferred by launder to a continuous, top-blown converting furnace.

Cooled, crushed and sized copper matte is added to the resident molten blister copper bath within the converting furnace in the general area in which the molten copper matte enters and is oxidized in the bath, i.e. near or in the area on the surface of the bath at which the oxygen-containing gas and flux form the foam/emulsion in which the matte is converted to blister copper. The melting of the solid copper matte into molten copper matte effectively removes the excess heat that is generated during the oxidation of the sulfur and iron values within the molten copper (both that from the separating furnace and that from the melting of the solid copper matte). The molten matte is oxidized by oxygen-enriched air blown through roof-mounted lances, and the iron values react with flux to form converter slag. This slag is either periodically or continuously skimmed from the molten blister copper. The blister copper has a purity of greater than about 98.5% copper, and it is tapped or overflows from one or more outlets into one or more launders for transfer to one or more anode furnaces.

In addition to forming a coolant for use in the converting furnace, another advantage of diverting molten copper matte from the separating furnace to solidification, size reduction and storage is that it provides an alternative outlet for the products from the continuous copper smelting process. In other words, if during the continuous process the converting furnace fills to capacity for whatever reason (downstream upset, smelting furnace overproduction, etc.), then the molten copper matte from the separating furnace can be diverted and processed into coolant until the converting furnace regains capacity to accept more molten matte.

Although this invention has been described in considerable detail through the preceding example, this detail is for the purpose of illustration only. Many variations and modifications can be made by one skilled in the art without departing from the spirit and scope of the invention as it is described in the appended claims.

What is claimed is:

1. A method for continuous copper smelting, the method comprising the steps of:

A. Providing a smelting furnace connected by first transfer means to a separating furnace, which in turn is connected by second transfer means to a continuous, top-blown converting furnace, which in turn is connected by third transfer means to at least one anode furnace;

B. Adding to and then melting and oxidizing in the smelting furnace a copper concentrate to produce a mixture of molten copper matte and slag;

C. Transferring the mixture of molten copper matte and slag by the first transfer means to the separating furnace in which the matte is separated from the slag;

D. Transferring the molten copper matte by the second transfer means to a bath of molten blister copper resident within the converting furnace in which the matte is oxidized to produce molten blister copper;

E. Adding a solid copper matte to the bath of molten blister copper for absorbing heat produced within the bath during the oxidation of the matte received from the separation furnace; and F. Transferring the molten blister copper by the third transfer means to at least one anode furnace in which the blister copper is refined into anode copper.

2. The method of claim 1 in which at least one of the transfer means is a ladle.

3. The method of claim 1 in which the first transfer means is a ladle.

4. The method of claim 1 in which at least one of the transfer means is a launder.

5. The method of claim 1 in which all of the transfer means are launders.

6. The method of claim 1 in which the solid copper matte comprises finely divided particles.

7. The method of claim 6 in which the addition of the solid copper matte maintains the temperature of the bath within the converting furnace within a range of 1,100 to 1,400° C.

8. The method of claim 7 in which only solid copper matte is added to the bath of molten blister copper for absorbing heat produced within the bath during oxidation of the matte received from the separation furnace.

9. A method for continuous copper smelting, the method comprising the steps of:

A. Providing a smelting furnace connected by first transfer means to a holding furnace, which in turn is connected by second transfer means to a continuous, top-blown converting furnace, which in turn is connected by third transfer means to at least one anode furnace;

B. Adding to and then melting and oxidizing in the smelting furnace a copper concentrate to produce molten copper matte;

C. Transferring the molten copper matte by the first transfer means to the holding furnace;

D. Transferring the molten copper matte by the second transfer means to a bath of molten blister copper resident within the converting furnace in which the matte is oxidized to produce molten blister copper;

E. Adding a solid copper matte to the bath of molten blister copper for absorbing heat produced within the bath during the oxidation of the matte received from the holding furnace; and F. Transferring the molten blister copper by the third transfer means to at least one anode furnace in which the blister copper is refined into anode copper.

10. The process of claim 9 in which the first and second transfer means are ladles.

* * * * *